US008629359B2

(12) United States Patent
Hackett

(10) Patent No.: US 8,629,359 B2
(45) Date of Patent: Jan. 14, 2014

(54) CIRCUIT BREAKER LOCKOUT

(75) Inventor: Jason O. Hackett, Canton, GA (US)

(73) Assignee: Panduit Corp., Tinley Park, IL (US)

( * ) Notice: Subject to any disclaimer, the term of this patent is extended or adjusted under 35 U.S.C. 154(b) by 409 days.

(21) Appl. No.: 13/028,432

(22) Filed: Feb. 16, 2011

(65) Prior Publication Data

US 2012/0205224 A1 Aug. 16, 2012

(51) Int. Cl.
*H01H 9/28* (2006.01)

(52) U.S. Cl.
USPC ..... 200/43.14

(58) Field of Classification Search
USPC ..... 200/43.14, 43.01, 43.11, 43.15, 43.16, 200/43.19, 43.21, 43.22, 318, 321, 322, 334
See application file for complete search history.

(56) References Cited

U.S. PATENT DOCUMENTS

| | | | | |
|---|---|---|---|---|
| 4,260,861 | A | 4/1981 | DiMarco | |
| 4,347,412 | A | 8/1982 | Mihara et al. | |
| 5,079,390 | A | 1/1992 | Costanzo et al. | |
| 5,147,991 | A | 9/1992 | Jordan, Sr. | |
| 5,300,740 | A | 4/1994 | Benda | |
| 5,322,980 | A | 6/1994 | Benda | |
| 5,500,495 | A | 3/1996 | Benda et al. | |
| 5,577,599 | A | 11/1996 | Turek et al. | |
| 5,732,815 | A | 3/1998 | Brouwer | |
| 5,817,998 | A | 10/1998 | Siebels et al. | |
| 6,396,008 | B1 | 5/2002 | Maloney et al. | |
| 6,469,264 | B2 * | 10/2002 | Benda | 200/43.14 |
| 6,617,532 | B1 | 9/2003 | Turek | |
| 6,696,651 | B1 | 2/2004 | Koopmeiners et al. | |
| 6,791,040 | B1 * | 9/2004 | Puhalla et al. | 200/43.14 |
| 7,262,376 | B2 | 8/2007 | Brojanac et al. | |
| 7,692,108 | B1 | 4/2010 | Larranaga et al. | |

FOREIGN PATENT DOCUMENTS

| | | | |
|---|---|---|---|
| EP | 0824263 | A2 | 2/1998 |
| EP | 2388790 | A1 | 11/2011 |
| WO | 0171757 | A1 | 9/2001 |

OTHER PUBLICATIONS

"Minature Circuit Breaker Lockouts—Tie-Bar", www.en.bradyeurope.com, printed Dec. 28, 2010, 2 pages.
"LOD-10 Socket & See Lockout Device for Miniture Circuit Breaker", www.cirlock.com.au, printed Dec. 28, 2010, 3 pages.
Master Lock® Safety SeriesT Locks, Tags & Other Products and Services, "Electrical Lockouts", www.safetyseries.com, printed Dec. 28, 2010, 4 pages.

* cited by examiner

*Primary Examiner* — Edwin A. Leon
(74) *Attorney, Agent, or Firm* — Christopher S. Clancy; Aimee E. McVady

(57) ABSTRACT

A circuit breaker lockout device is disclosed. The circuit breaker lockout device includes a body having a top, a bottom, a front, a back and sides. The top of the body includes a padlock hole defined by a channel that is parallel to the body. The body also includes a toggle screw that extends through the body to secure the lockout device to a circuit breaker.

7 Claims, 18 Drawing Sheets

CIRCUIT BREAKER LOCKOUT

FIELD OF THE INVENTION

The present invention relates to a circuit breaker lockout device, and more particularly to a circuit breaker lockout device that allows adjacent circuit breakers to be locked out.

BACKGROUND OF THE INVENTION

The desire to maintain the setting of certain toggle switches in either the "on" or "off" position has existed for many years. The Occupational Safety and Health Administration (OSHA) has placed in effect rules which require that energy sources be locked out prior to any work being performed on an electrical circuit. These rules are intended to prevent injuries resulting from someone turning on the power while maintenance or other work is being done on that circuit. A variety of circuit breaker lockout devices are known in the art and generally include a housing which is positioned over the toggle switch to prevent movement of the toggle switch as well as having apertures through which a shackle of a lock can be inserted to prevent removal of the lockout device.

Typically, individual padlocks cannot be installed on adjacent lockout devices due to space constraints. Prior circuit breaker lockout devices generally receive a lock that is positioned perpendicular to the circuit breaker. The perpendicular orientation of the padlock prohibits adjacent circuit breakers from receiving an individual lockout device. As a result, one padlock is often used with multiple circuit breaker lockout devices. This is not desirable since all circuit breaker lockout devices would have to be unlocked at the same time. Thus, it is desirable to provide a circuit breaker lockout device that enables adjacent circuit breakers to be individually locked.

SUMMARY OF THE INVENTION

The present invention is directed to a circuit breaker lockout device that enables adjacent circuit breakers to be individually locked. The circuit breaker lockout device includes a body having a top, a bottom, a front, a back and sides. The top of the body includes a padlock hole. The padlock hole is defined by a channel that is parallel to the body. A padlock is installed in the padlock hole to secure the circuit breaker lockout device. The channel positions the padlock in a plane parallel to the circuit breaker lockout device. The circuit breaker lockout device also includes a toggle screw that extends through the body. The toggle screw secures the circuit breaker lockout device to a circuit breaker.

DETAILED DESCRIPTION

Figure 1:
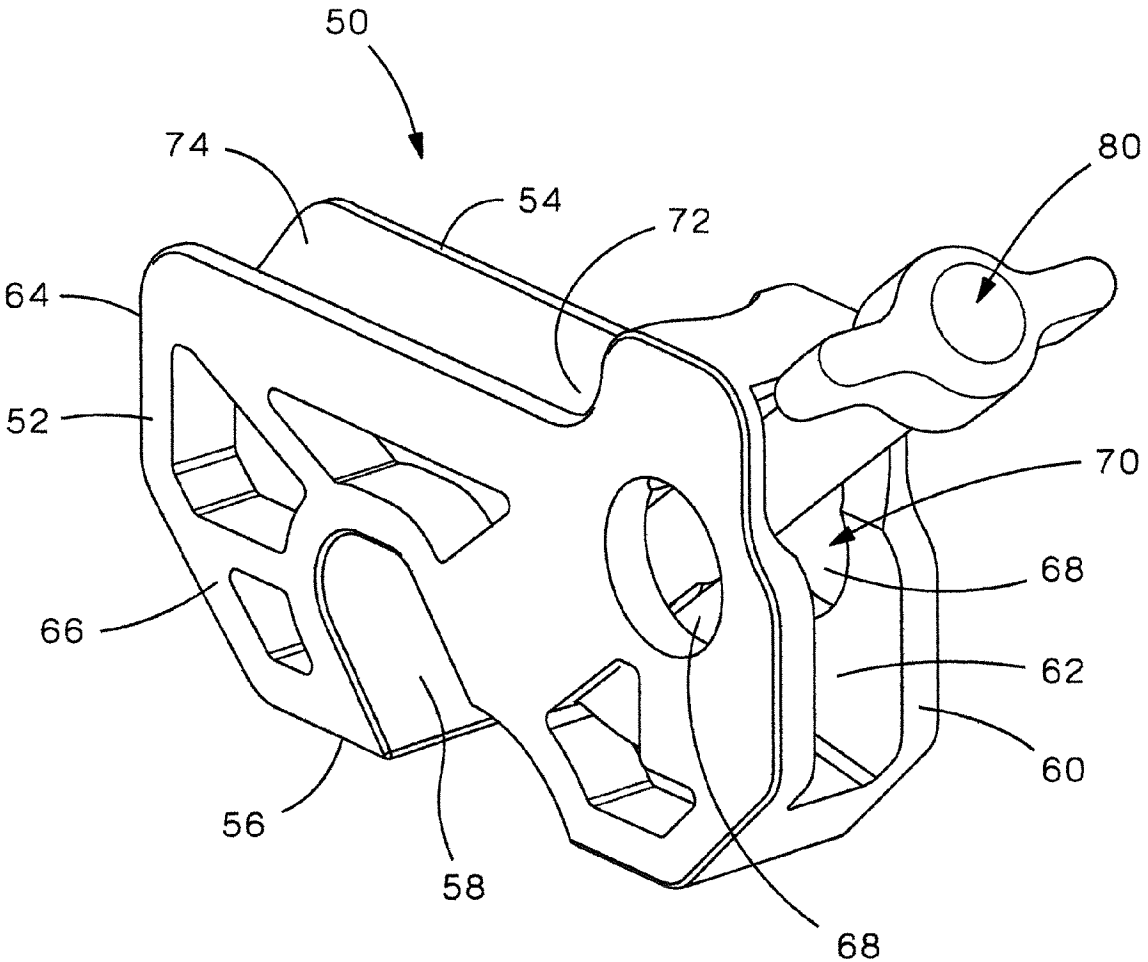
FIG. 1 is a perspective view of the circuit breaker lockout device of the present invention.
Figure 2:
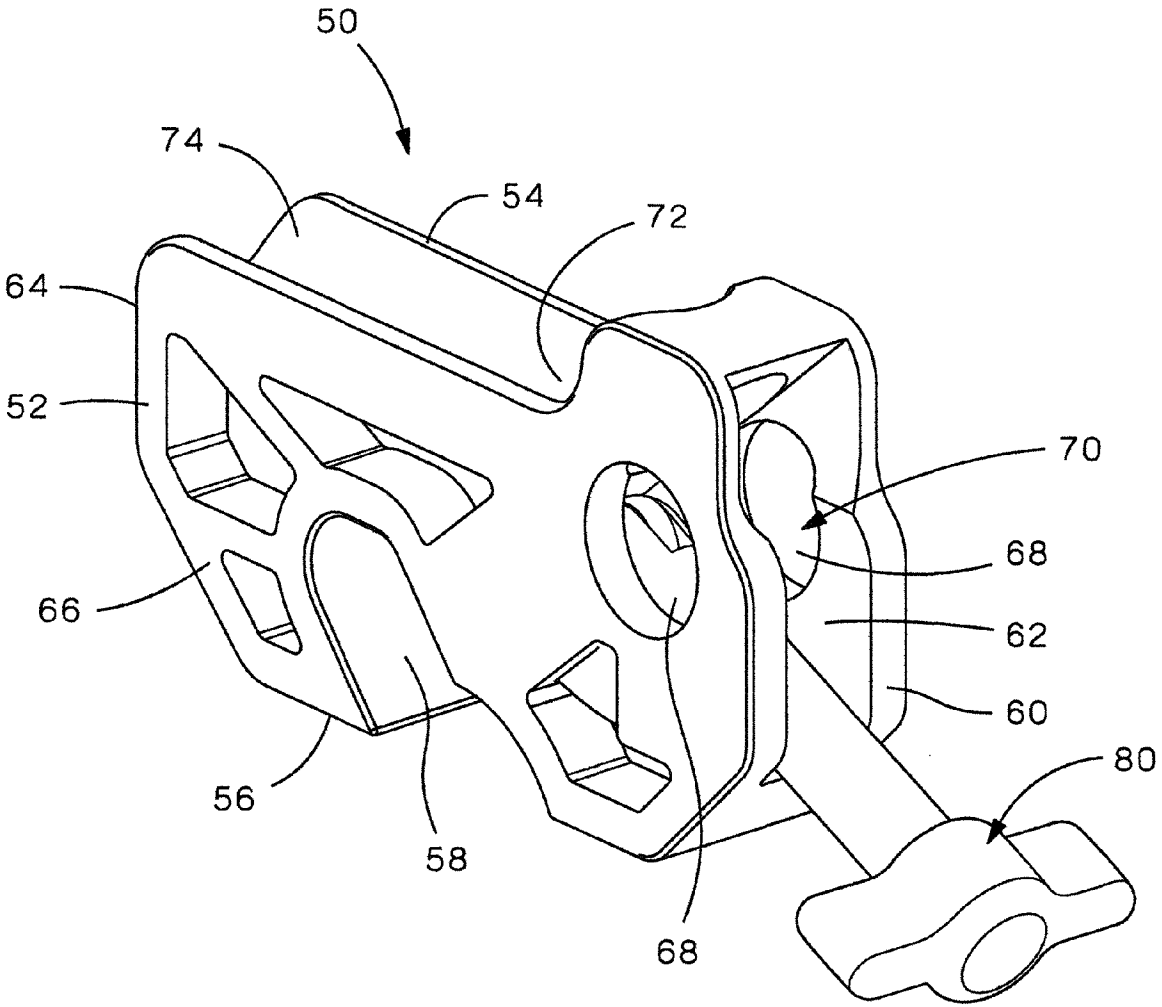
FIG. 2 is a perspective view of the circuit breaker lockout device of FIG. 1 with the toggle screw pivoted to a non-operable position.
Figure 3:
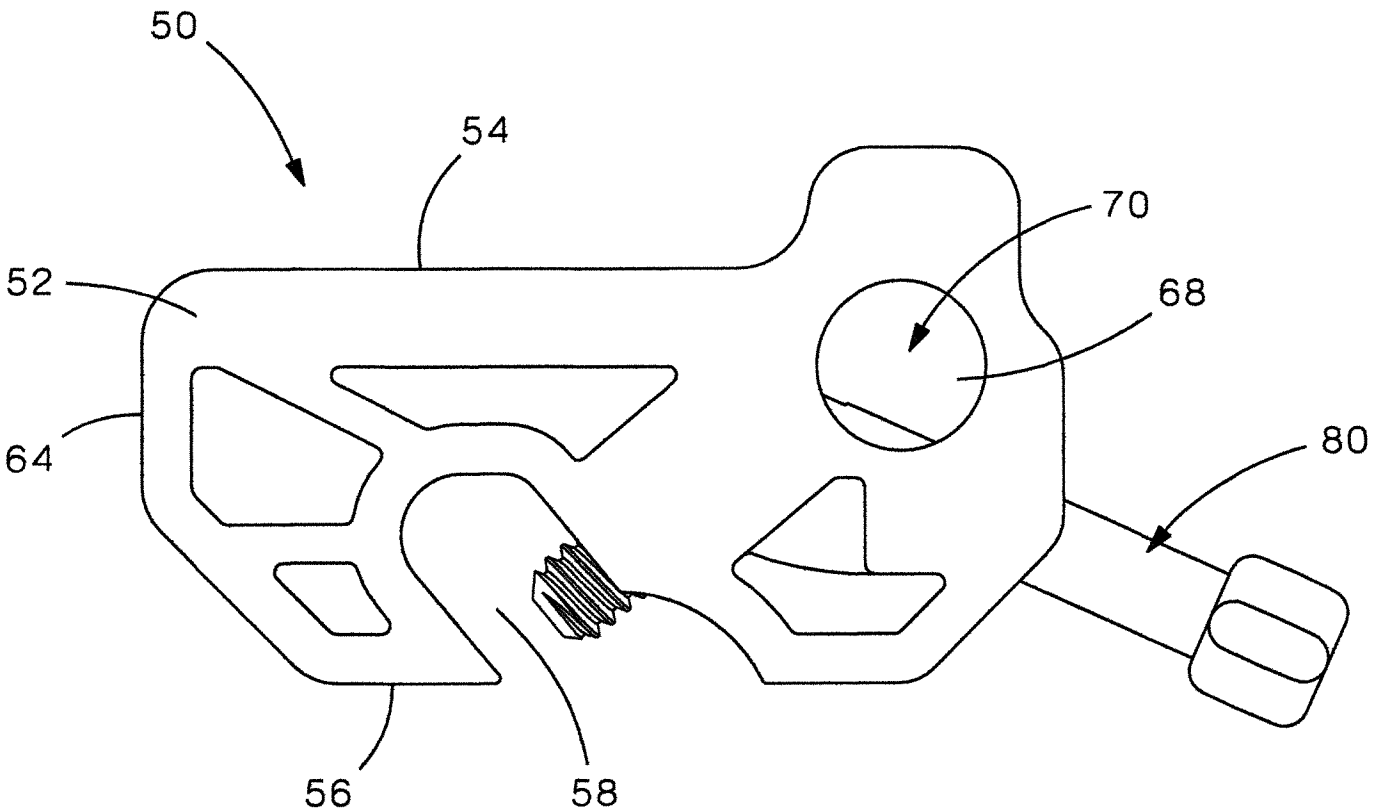
FIG. 3 is a side view of the circuit breaker lockout device of FIG. 2.

FIGS. 1-11 illustrate a circuit breaker lockout device 50 of the present invention. The circuit breaker lockout device 50 includes a body 52 with a top 54, a bottom 56, a front 60, a back 64 and sides 66.

The bottom 56 of the body 52 includes an angled opening 58. As described below, the angled opening 58 receives the switch 152 of a circuit breaker 150 when the circuit breaker lockout device 50 is positioned over the circuit breaker 150. The front 60 of the body 52 includes a slot 62 extending from the top 54 towards the bottom 56 of the body 52. Each side 66 of the body 52 includes a padlock hole 68 defining an opening 70 that extends from each side 66 through the body 52 in a plane perpendicular to the body 52. The top 54 of the body 52 includes a padlock hole 72. The padlock hole 72 is defined by a channel 74 that is parallel to the body 52 of the lockout device 50. As discussed below with respect to FIGS. 10 and 11, the padlock hole 72 maintains a padlock 160 in a position parallel to the circuit breaker lockout device 50 to enable adjacent circuit breakers 150 to be locked out.

Figure 4:
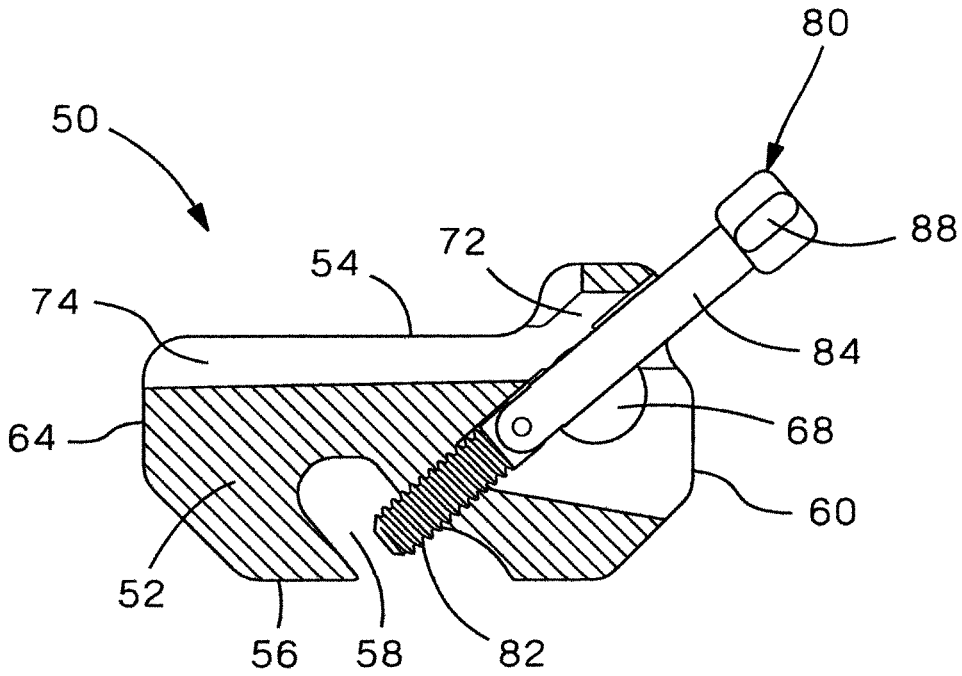
FIG. 4 is a cross sectional view of the circuit breaker lockout device of FIG. 1.
Figure 5:
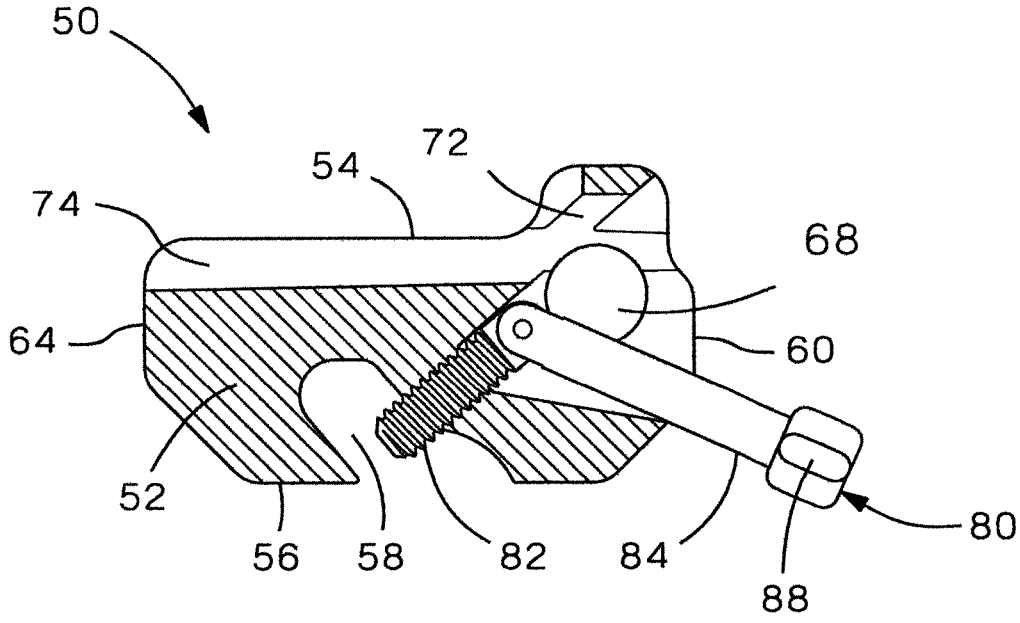
FIG. 5 is a cross sectional view of the circuit breaker lockout device of FIG. 2.

The body 52 also includes a toggle screw 80 for securing the circuit breaker lockout device 50 on a circuit breaker 150. As illustrated in FIGS. 4 and 5, the toggle screw 80 includes a first member set screw 82 and a second member 84 pivotally secured to the first member 82. The toggle screw 80 is installed in the body 52 at an angle with the first member 82 extending into the angled opening 58 and the second member 84 extending through the slot 62 in the front 60 of the body 52. The second member 84 includes outwardly extending wings 88 for providing a handle to enable a user to easily twist or pivot the toggle screw 80.

FIGS. 6-11 illustrate the circuit breaker lockout device 50 installed on a circuit breaker 150. The circuit breaker lockout device 50 is narrower than the overall width of the circuit breaker 150 and the width of the walls 154 that surround the switch 152. Before a padlock 160 is installed in one of the padlock holes 68, 72, the toggle screw 80 secures the circuit breaker lockout device 50 to the circuit breaker 150. The toggle screw 80 is twisted until the first member 82 is driven against the switch 152 to secure the lockout device 50 to the circuit breaker 150. Once the first member 82 is secure, the second member 84 of the toggle screw 80 pivots downward in the slot 62 to a non-operable position in which the first member 82 cannot be turned. When the second member 84 is in the non-operable position, the padlock holes 68, 72 are accessible.

Figure 6:
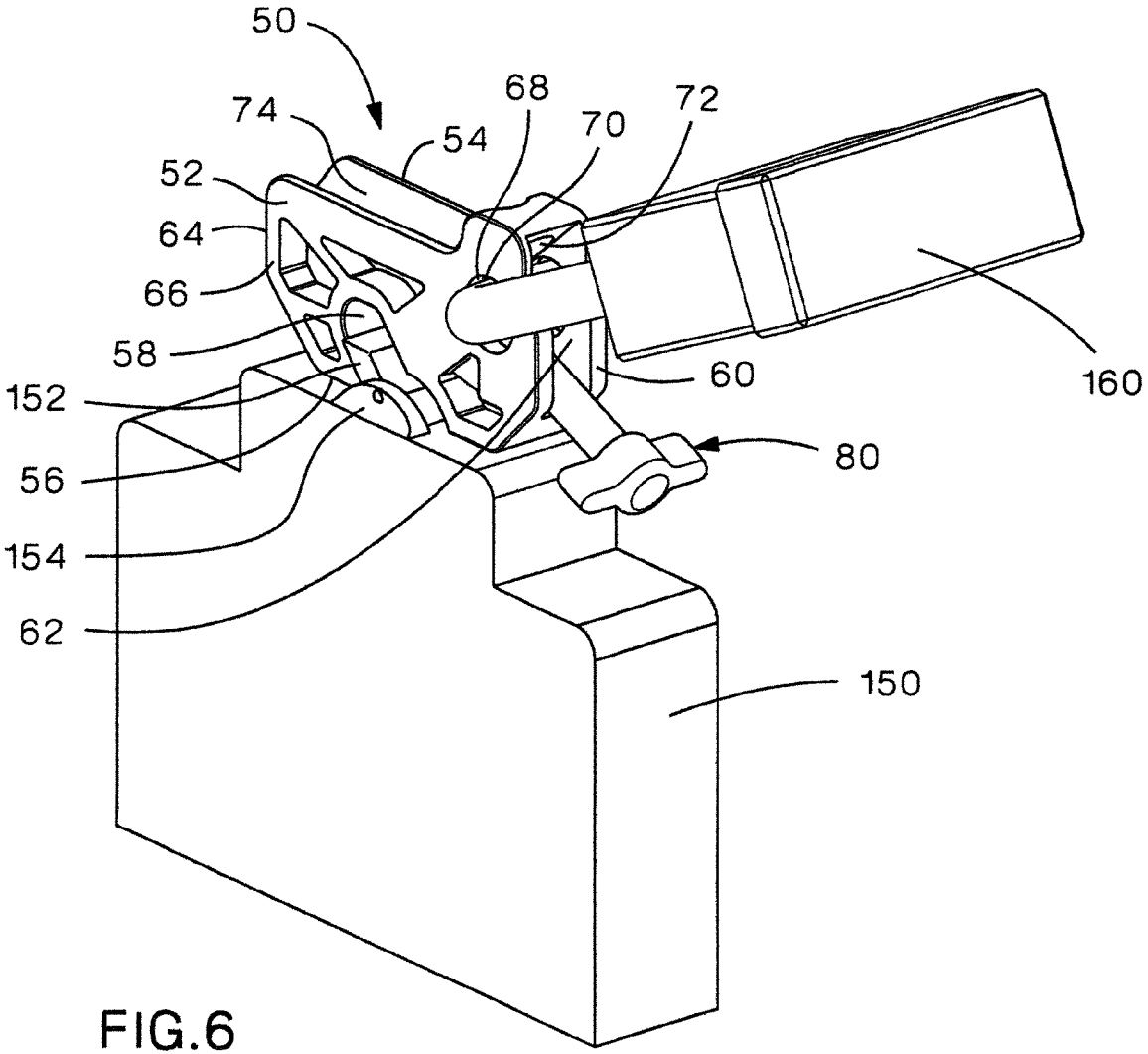
FIG. 6 is a perspective view of the circuit breaker lockout device of FIG. 2 installed on a circuit breaker and locked out with a padlock positioned perpendicular to the circuit breaker.
Figure 7:
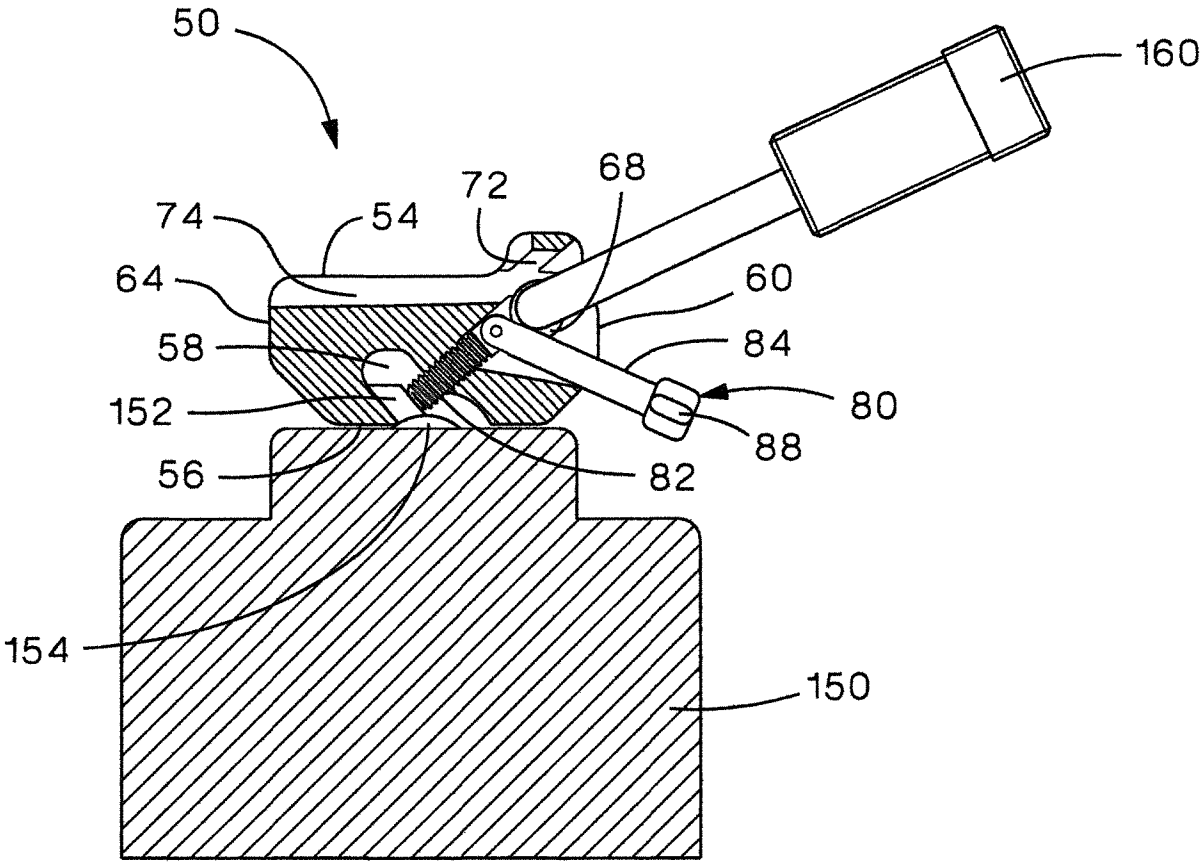
FIG. 7 is a cross sectional view of the circuit break lockout device of FIG. 6.

After the toggle screw 80 is tightened and pivoted, a padlock 160 may be installed in the circuit breaker lockout device 50. FIGS. 6 and 7 illustrate the circuit breaker lockout device 50 with a padlock 160 installed in the padlock hole 68 to secure the circuit breaker lockout device 50 over the circuit breaker 150. The padlock 160 is positioned perpendicular to the circuit breaker lockout device 50.

Figure 8:
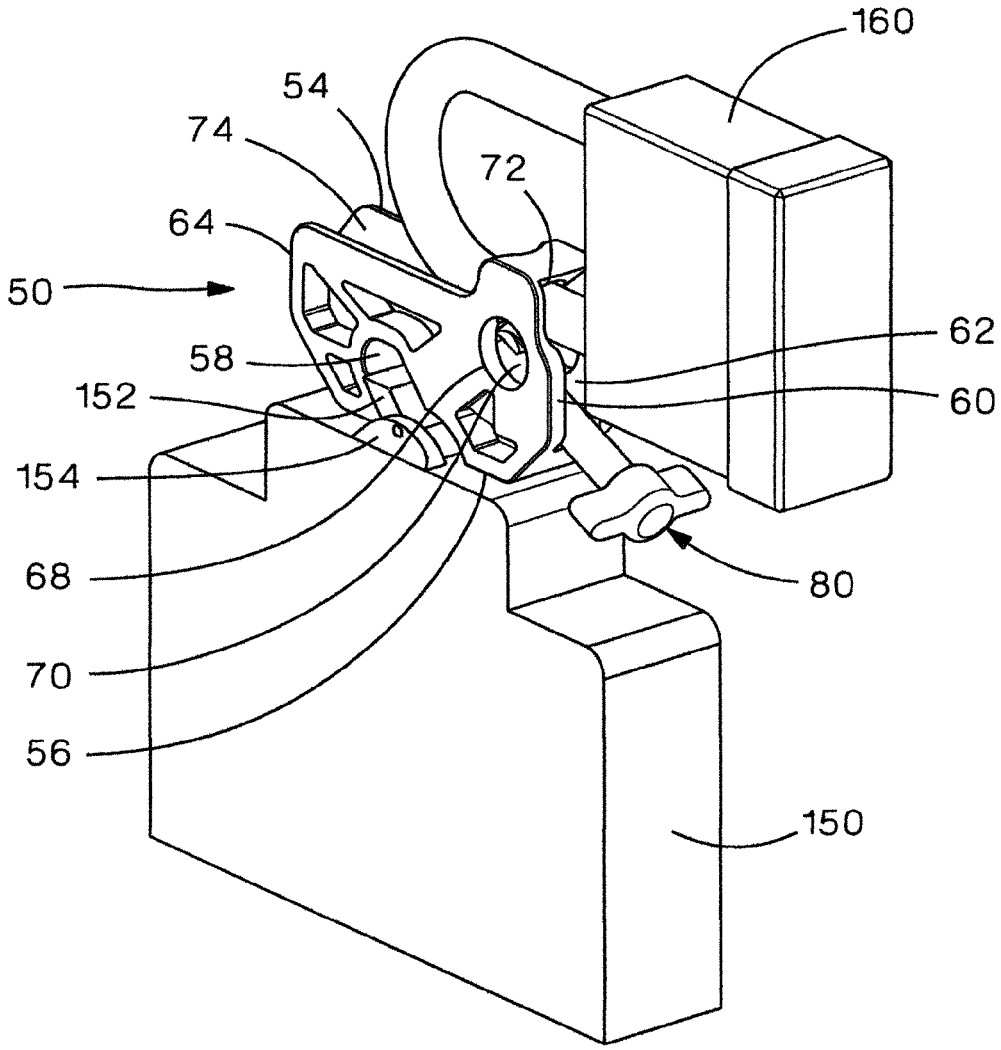
FIG. 8 is a perspective view of the circuit breaker lockout device of FIG. 2 installed on a circuit breaker and locked out with a padlock positioned parallel to the circuit breaker.
Figure 9:
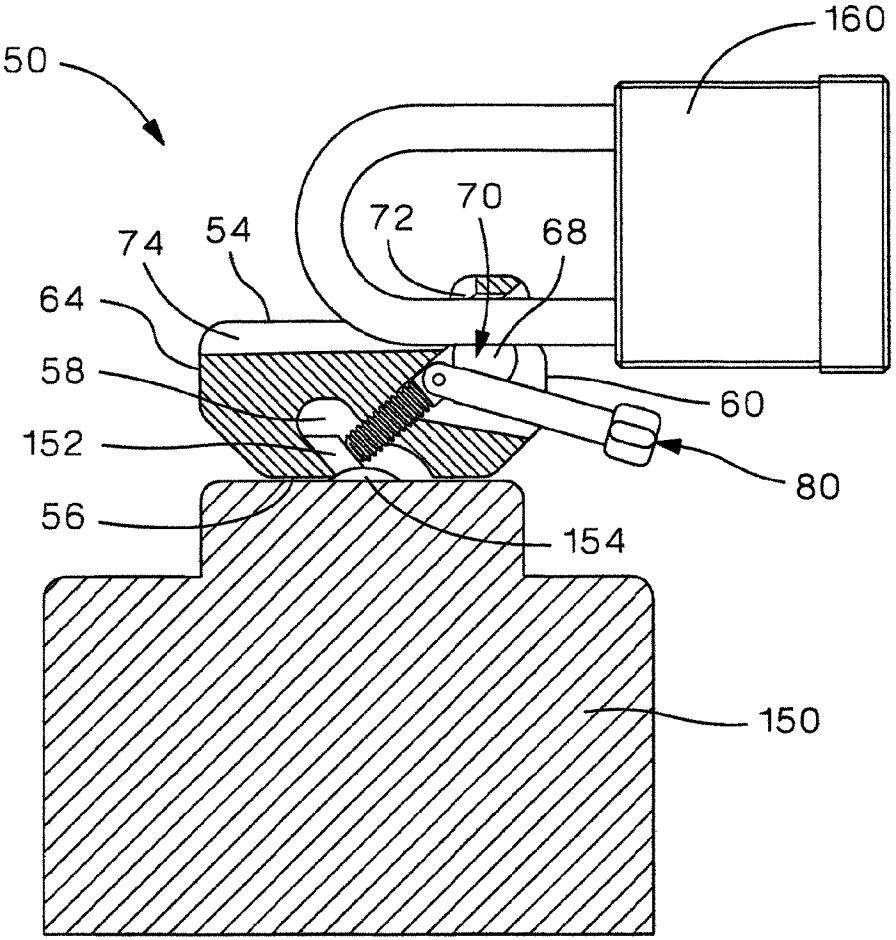
FIG. 9 is a cross sectional view of the circuit breaker lockout device of FIG. 8.

Alternatively, as illustrated in FIGS. 8 and 9, a padlock 160 may be installed in the padlock hole 72 of the circuit breaker lockout device 50. When the padlock 160 is installed in the padlock hole 72, the padlock 160 remains parallel to the circuit breaker lockout device 50. As illustrated in FIG. 8, the width of the installed padlock 160 does not exceed the width of the circuit breaker 150. As a result, adjacent circuit breakers 150 may receive a circuit breaker lockout device 50 to be locked out.

Figure 10:
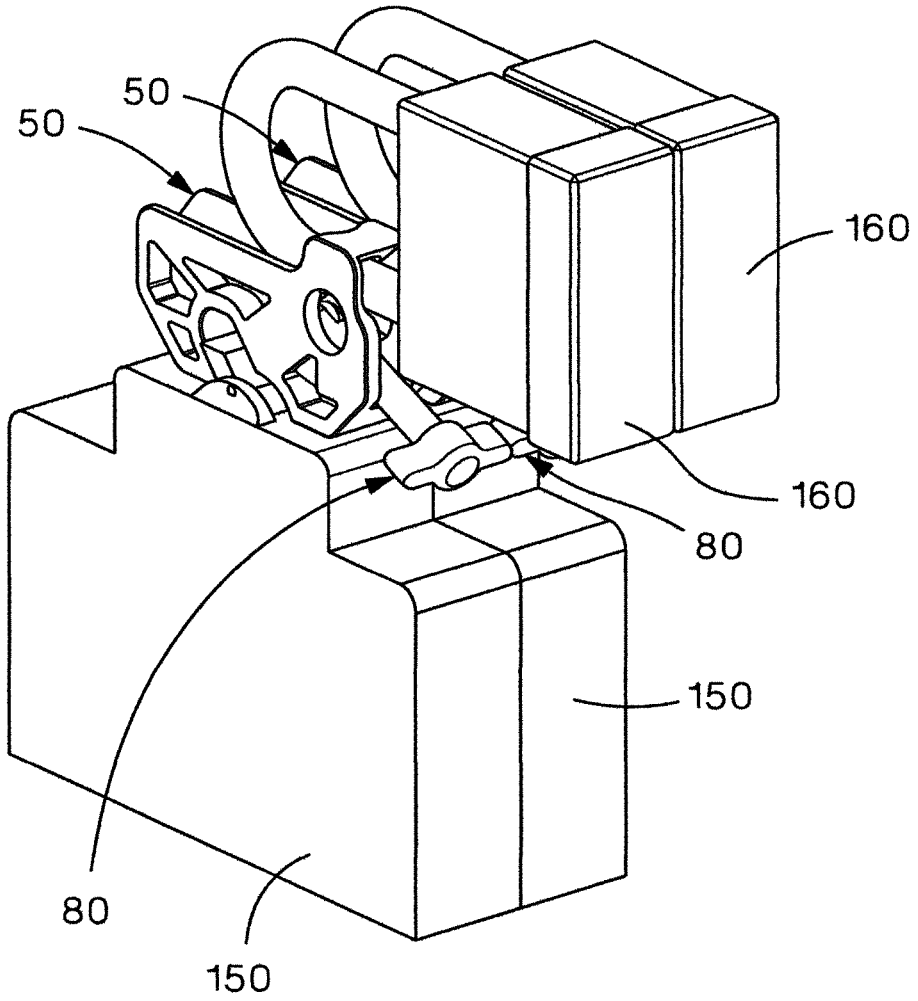
FIG. 10 is a perspective view of adjacent circuit breakers locked out with the circuit breaker lockout devices of FIG. 8.
Figure 11:
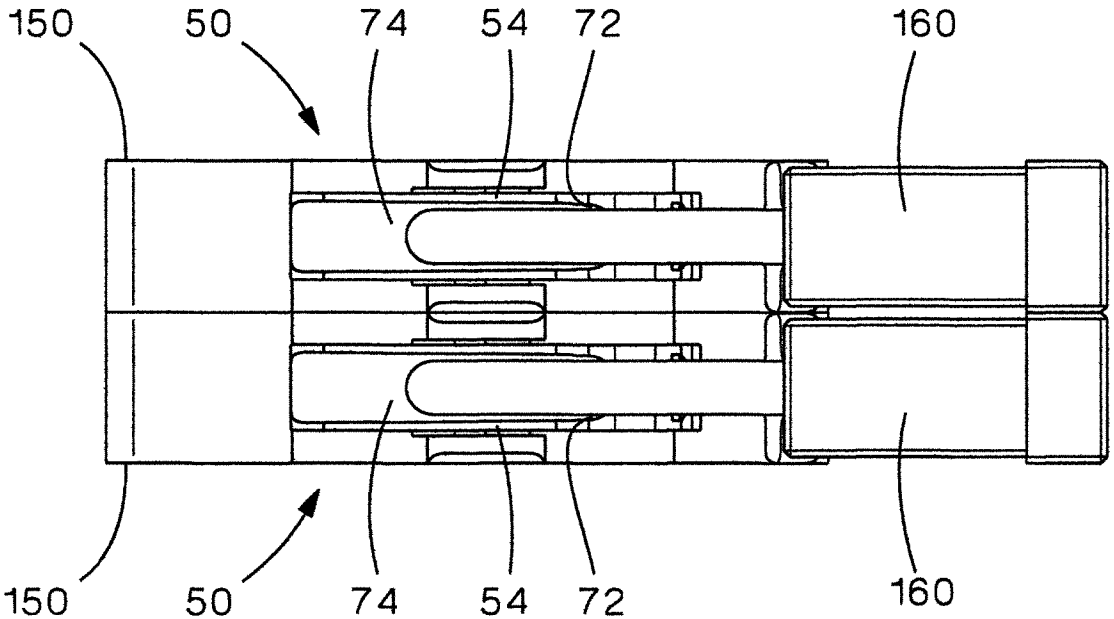
FIG. 11 is a top view of the adjacent circuit breaker lockout devices of FIG. 10.
Figure 12:
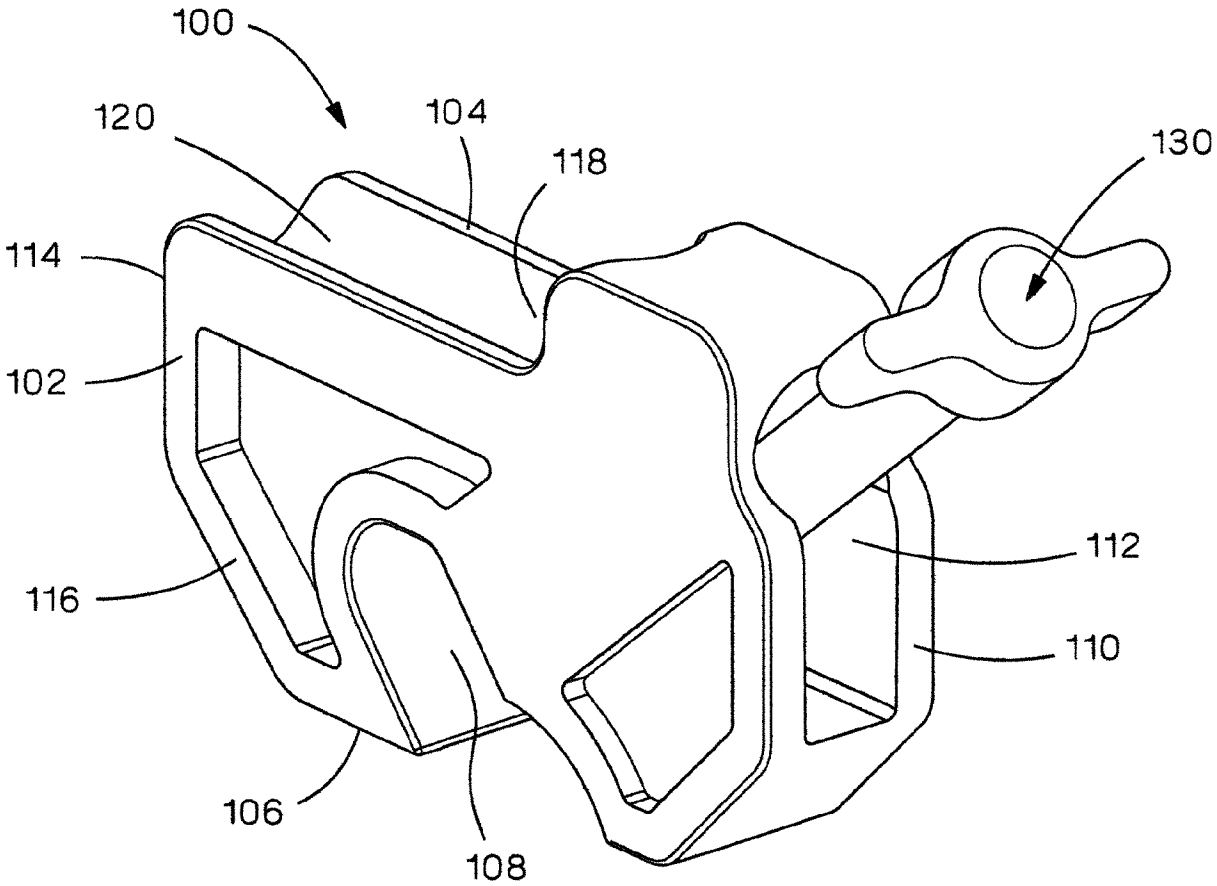
FIG. 12 is a perspective view of an alternative circuit breaker lockout device of the present invention.
Figure 13:
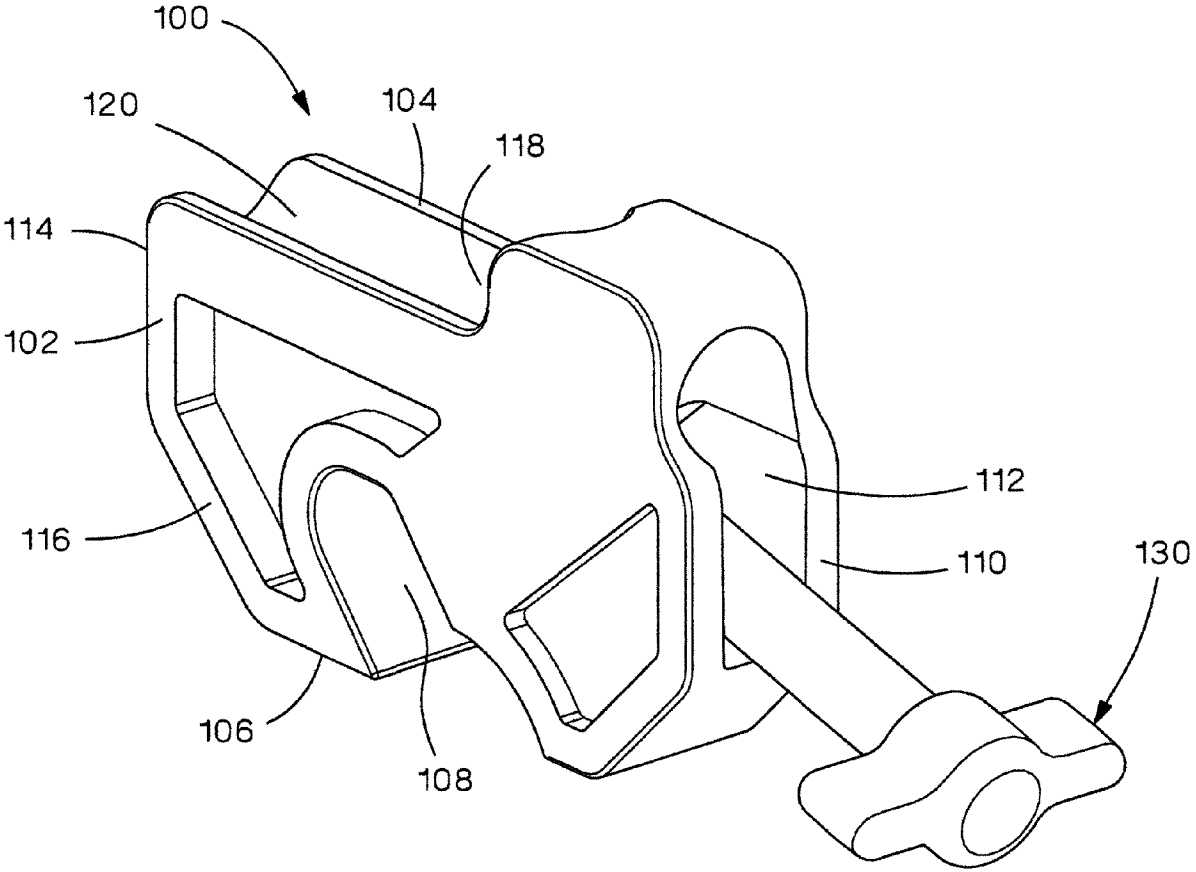
FIG. 13 is a perspective view of the circuit breaker lockout device of FIG. 12 with the toggle screw pivoted to a non-operable position.
Figure 14:
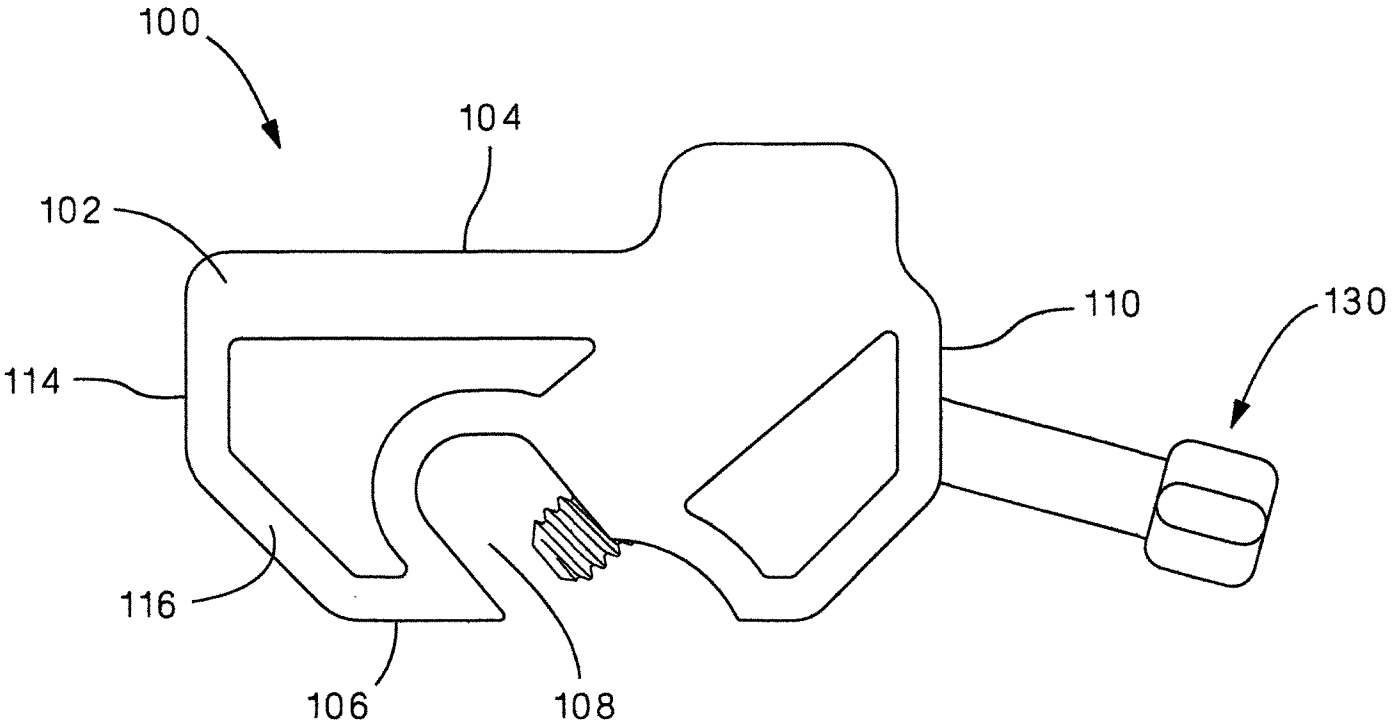
FIG. 14 is a side view of the circuit breaker lockout device of FIG. 13.

FIGS. 10 and 11 illustrate adjacent circuit breakers 150 locked via adjacent circuit break lockout devices 50. The orientation of the padlock hole 72 in the circuit breaker lockout device 50 enables the adjacent circuit breakers 150 to be locked. Additionally, the orientation of the padlock holes 68, 72 in the circuit breaker lockout device 50 enables a padlock 160 to be installed in two directions, as desired.

FIGS. 12-20 illustrate an alternative circuit breaker lockout device 100. The alternative circuit breaker lockout device 100 includes a body 102 with a top 104, a bottom 106, front 110, back 114 and sides 116. The bottom 106 of the body 102 includes an angled opening 108. The front 110 of the body 102 includes a slot 112 extending from the top 104 towards the bottom 106 of the body 102. The top 104 of the body 102 includes a padlock hole 118 that is defined by a channel 120 that extends parallel to the body 102 of the lockout device 100.

Figure 15:
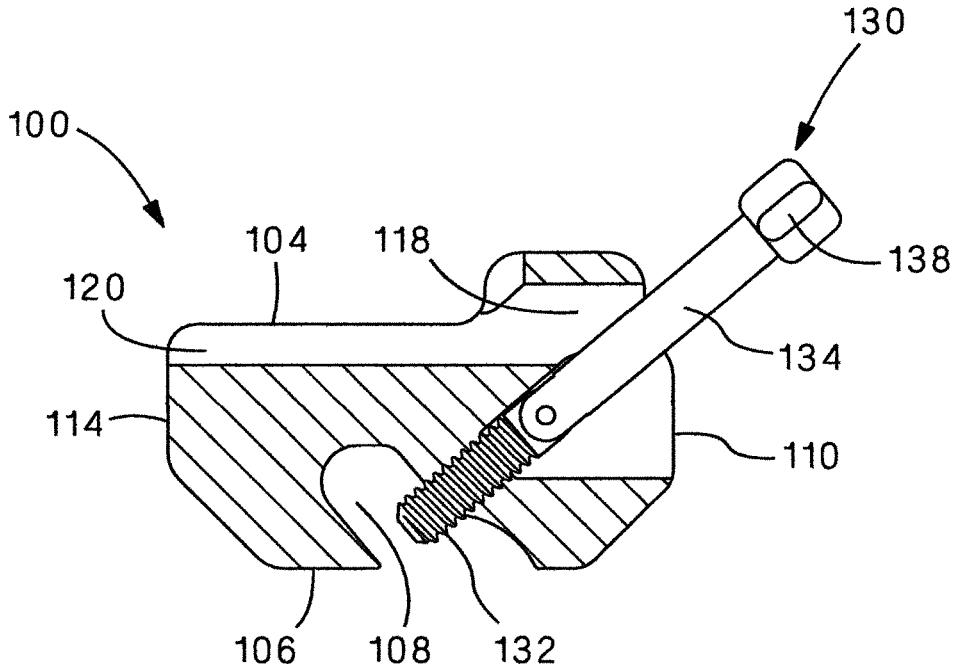
FIG. 15 is a cross sectional view of the circuit breaker lockout device of FIG. 12.
Figure 16:
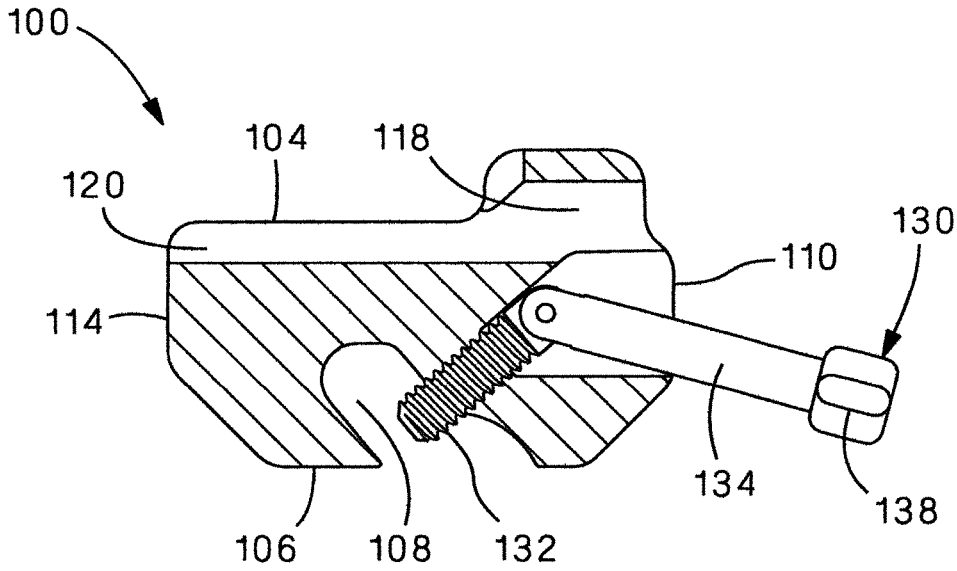
FIG. 16 is a cross sectional view of the circuit breaker lockout device of FIG. 13.
Figure 17:
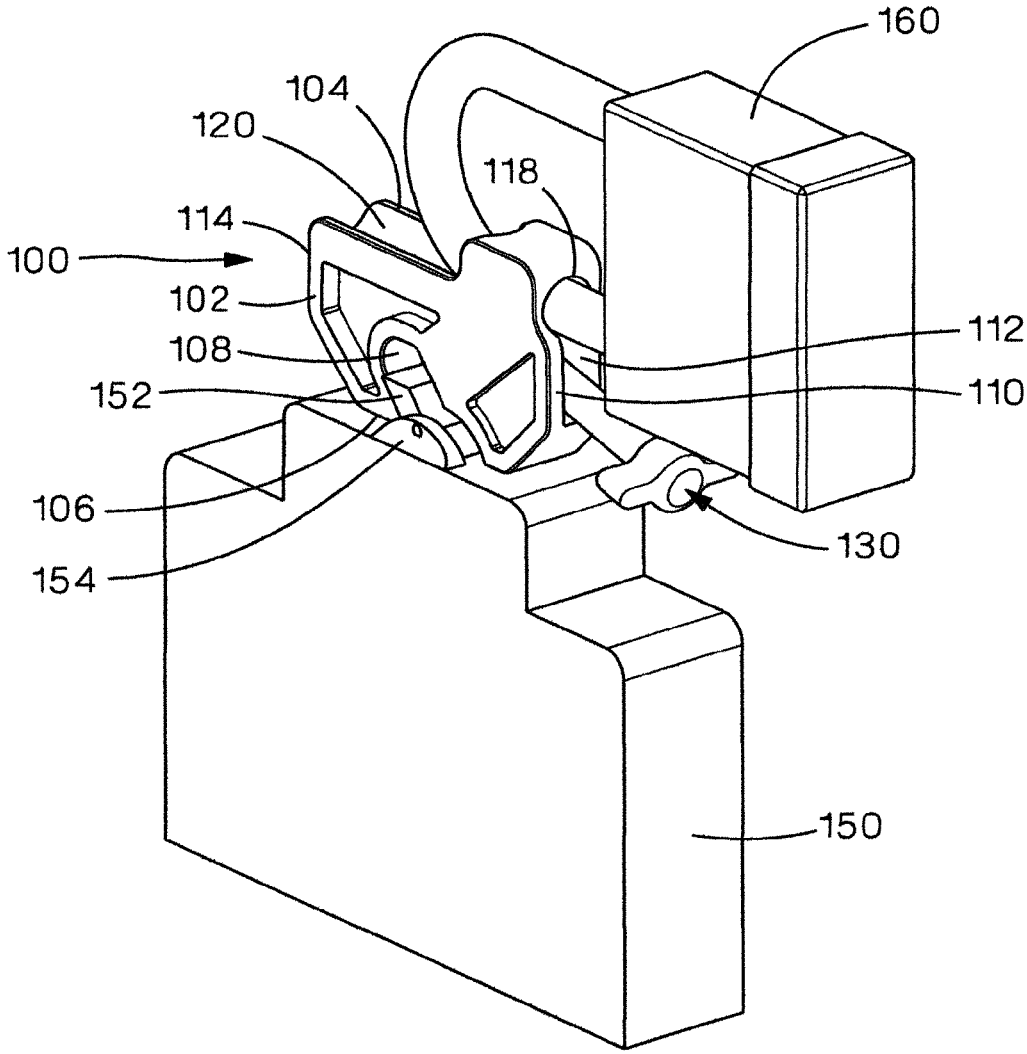
FIG. 17 is a perspective view of the circuit breaker lockout device of FIG. 13 installed on a circuit breaker and locked out with a padlock positioned parallel to the circuit breaker.
Figure 18:
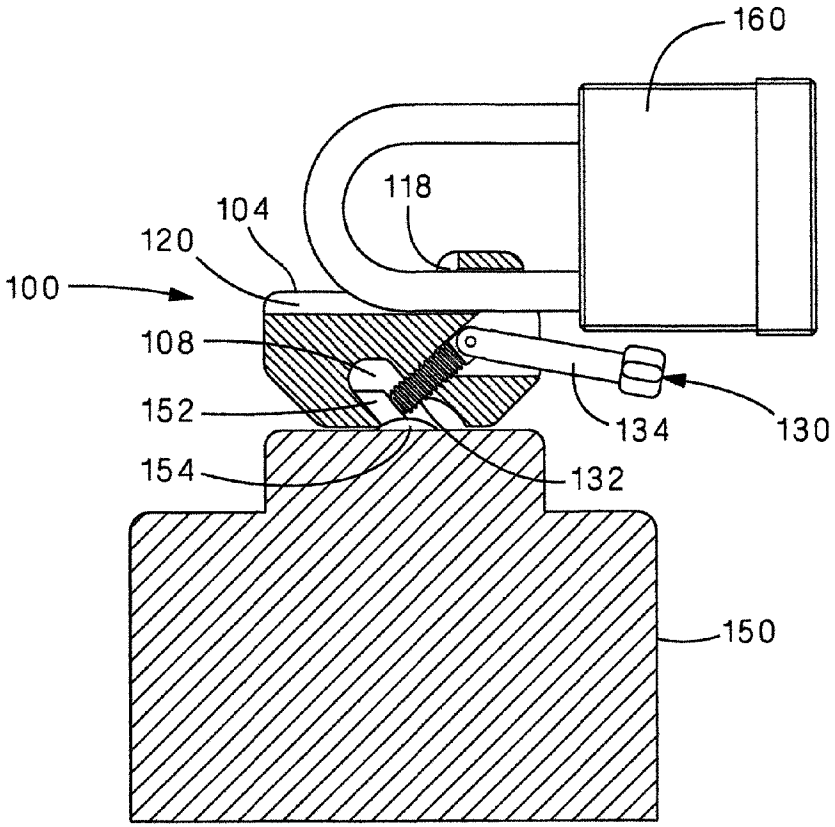
FIG. 18 is a cross sectional view of the circuit breaker lockout device of FIG. 17.

The body 102 also includes a toggle screw 130 for securing the circuit breaker lockout device 100 on a circuit breaker 150. The toggle screw 130 is identical to the toggle screw 80 described above with respect to FIGS. 1-11. As illustrated in FIGS. 15 and 16, the toggle screw 130 includes a first member 132 and a second member 134 pivotally secured to the first member 132. The toggle screw 130 is installed in the body 102 at an angle with the first member 132 extending into the angled opening 108 and the second member 134 extending through the slot 112 in the front 110 of the body 102. The second member 134 includes outwardly extending wings 138 for providing a handle to enable a user to easily twist or pivot the toggle screw 130.

Figure 19:
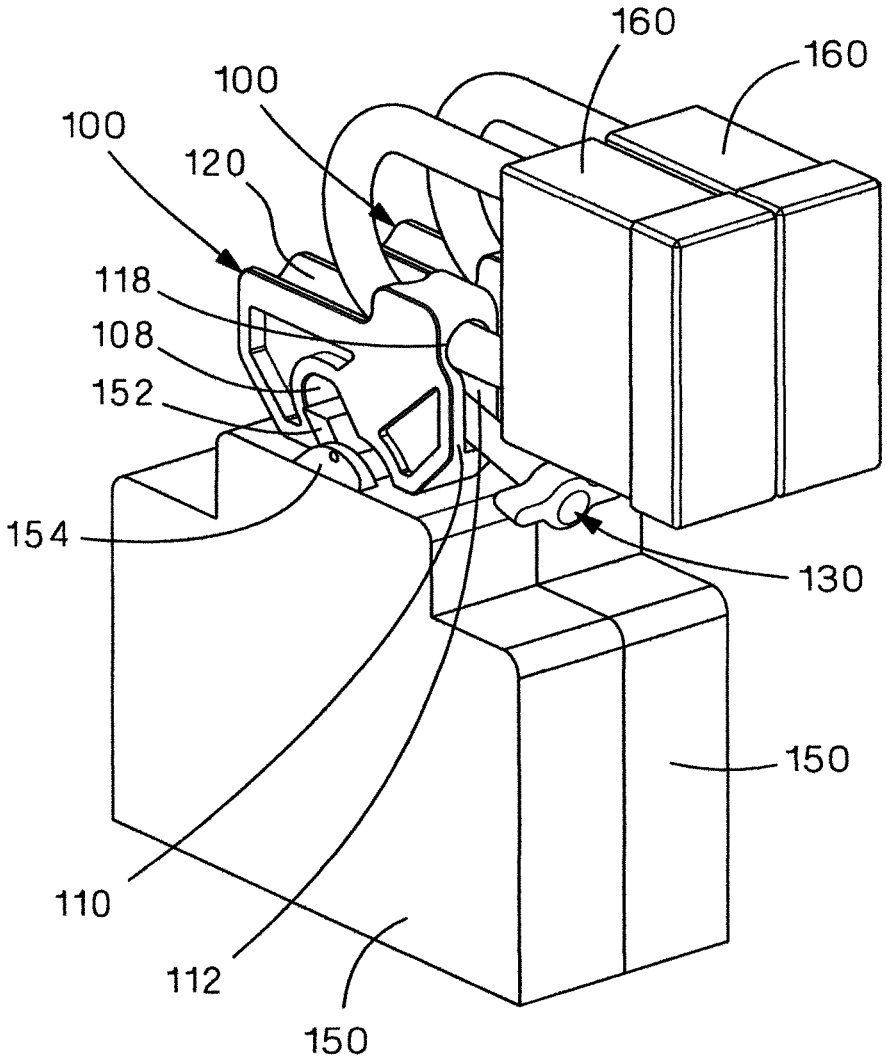
FIG. 19 is a perspective view of adjacent circuit breakers locked out with circuit breaker lockout devices of FIG. 17.
Figure 20:
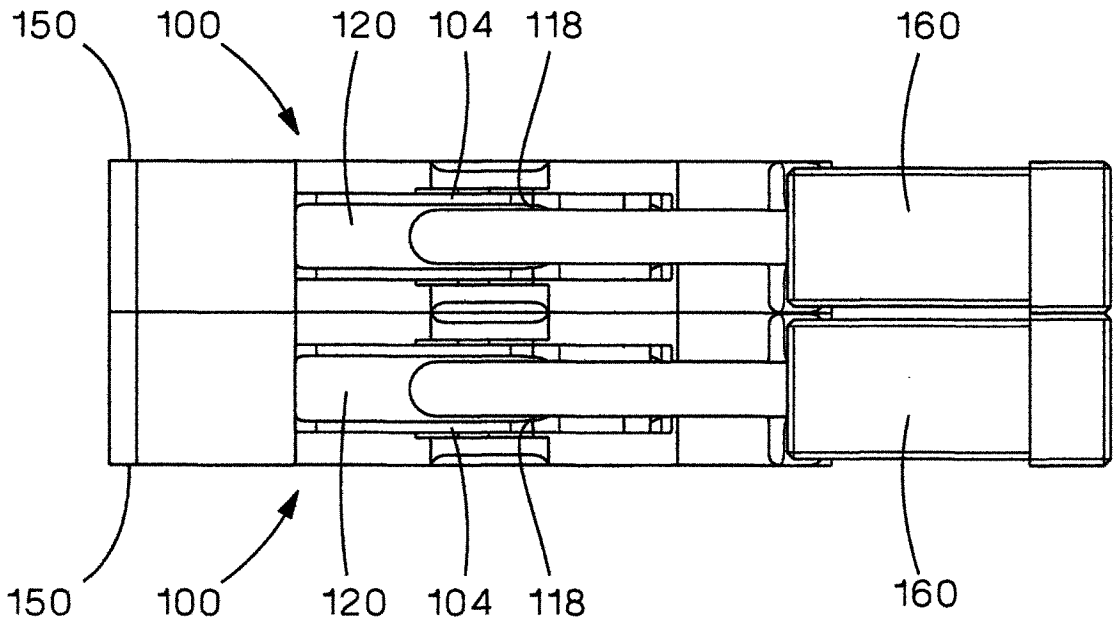
FIG. 20 is a top view of the adjacent circuit breaker lockout devices of FIG. 19.

FIGS. 17-20 illustrate the circuit breaker lockout device 100 installed on a circuit breaker 150. As described above, before a padlock 160 is installed in the padlock hole 118, the toggle screw 130 secures the circuit breaker lockout device 100 to the circuit breaker 150. Once the first member 132 is secure, the second member 134 of the toggle screw 130 pivots downward in the slot 112 to a non-operable position. A padlock 160 may now be installed in the padlock hole 118 of the circuit breaker lockout device 100. The padlock 160 remains parallel to the circuit breaker lockout device 100 with the width of the padlock 160 not exceeding the width of the circuit breaker 150. As a result, as illustrated in FIGS. 19 and 20, a circuit breaker lockout device 100 may be positioned on adjacent circuit breakers 150 to lockout adjacent circuit breakers 150.

The orientation of the padlock holes of the circuit breaker lockout device of the present invention enables a user to secure the circuit breaker lockout device onto adjacent circuit breakers thereby individually locking the adjacent circuit breakers.

Furthermore, while the particular preferred embodiments of the present invention have been shown and described, it will be obvious to those skilled in the art that changes and modifications may be made without departing from the teaching of the invention. The matter set forth in the foregoing description and accompanying drawings is offered by way of illustration only and not as limitation. The actual scope of the invention is intended to be defined in the following claims when viewed in their proper perspective based on the prior art.

The invention claimed is:

1. A circuit breaker lockout device comprising, a body having a top, a bottom, a front, a back and sides, wherein the sides define a channel, the channel extends a length of the body from the back to the front of the body, wherein the top of the body includes a padlock hole positioned within the channel; and a toggle screw extending through the body for securing the body to a circuit breaker.

2. The circuit breaker lockout device of claim 1, wherein the padlock hole in the channel positions a padlock along the length of the circuit breaker lockout device.

3. The circuit breaker lockout device of claim 1, further comprising a second padlock hole through the sides of the body, wherein the second padlock hole intersects the channel.

4. The circuit breaker lockout device of claim 1, wherein the bottom having an angled opening for receiving a switch on the circuit breaker.

5. The circuit breaker lockout device of claim 1, wherein the front having a slot extending from the top of the body towards the bottom of the body, the toggle screw extending through the slot.

6. The circuit breaker lockout device of claim 5, wherein the toggle screw pivots from a top of the slot to a non-operable positioned at a bottom of the slot.

7. A circuit breaker lockout device comprising, a body having a first padlock receiving opening defined by a channel extending a length of the body, the first padlock receiving opening orients a padlock in a first orientation and a second padlock receiving opening extending from a first side of the body to a second side of the body, the second padlock receiving opening orients the padlock in a second orientation;

wherein the second padlock receiving opening is transverse to the first padlock receiving opening, and a toggle screw extending through the body for securing the body to a circuit breaker.

* * * * *

UNITED STATES PATENT AND TRADEMARK OFFICE

CERTIFICATE OF CORRECTION

PATENT NO. : 8,629,359 B2
APPLICATION NO. : 13/028432
DATED : January 14, 2014
INVENTOR(S) : Jason O. Hackett It is certified that error appears in the above-identified patent and that said Letters Patent is hereby corrected as shown below:

In the Specification

Column 2, line 1 which reads "FIG 7 is a cross-sectional view of the circuit break lockout..." should read "FIG. 7 is a cross-sectional view of the circuit breaker lockout..."

Column 3, line 30 which reads "...locked via adjacent circuit break locout devices..." should read "...locked via adjacent circuit breaker lockout devices..."

Signed and Sealed this
Twenty-eighth Day of October, 2014

Michelle K. Lee

Michelle K. Lee
*Deputy Director of the United States Patent and Trademark Office*